US006293214B1

(12) United States Patent
Tajima

(10) Patent No.: US 6,293,214 B1
(45) Date of Patent: Sep. 25, 2001

(54) SEWING MACHINE FRAME DRIVE DEVICE

(75) Inventor: Ikuo Tajima, Kasugai (JP)

(73) Assignee: Tokai Kogyo Mishin Kabushiki Kaisha, Aichi (JP)

( * ) Notice: Subject to any disclaimer, the term of this patent is extended or adjusted under 35 U.S.C. 154(b) by 0 days.

(21) Appl. No.: 09/547,378

(22) Filed: Apr. 13, 2000

(30) Foreign Application Priority Data

Apr. 21, 1999 (JP) ..... 11-113798
Jan. 12, 2000 (JP) ..... 12-003903

(51) Int. Cl.[7] ..... D05B 21/00
(52) U.S. Cl. ..... 112/470.18
(58) Field of Search ..... 112/470.18, 470.14, 112/470.06, 102.5, 103; 451/354

(56) References Cited

U.S. PATENT DOCUMENTS 3,830,175 * 8/1974 Levor ..... 112/470.06
5,003,895 * 4/1991 Talanker ..... 112/103
5,018,462 * 5/1991 Brocklehurst ..... 112/470.18
5,809,918 * 9/1998 Tajima et al. ..... 112/103
5,964,645 * 10/1999 Jemt ..... 451/41

* cited by examiner

*Primary Examiner*—Peter Nerbun
(74) *Attorney, Agent, or Firm*—Koda & Androlia

(57) ABSTRACT

A sewing machine frame drive device capable of precisely conveying on an X-Y coordinate plane a frame, on which an article being sewn is set, comprising X-direction drive units (6) and Y-direction drive units (7) for imparting driving forces to a frame (5) of various types, on which an article being sewn is set, the units being composed of screw rods (11) rotatingly driven by motors (23) in alternate directions, and moving bodies (12) threaded on the screw rods (11).

3 Claims, 10 Drawing Sheets

SEWING MACHINE FRAME DRIVE DEVICE

FIELD OF THE INVENTION

The present invention relates to a sewing machine frame drive device, more particularly, to a device for freely conveying on an X-Y coordinate plane a frame, on which an article being sewn is set.

DESCRIPTION OF THE RELATED ART

Generally known as a sewing machine frame drive device of the type is a drive unit comprising two timing pulleys disposed with a predetermined spacing therebetween, a timing belt extended between the timing pulleys in an endless fashion, and a driving force transmitting member mounted on the linear running portion of the timing belt. With the drive unit, a shaft of one of the timing pulleys is rotatingly driven by a motor, whereby the timing belt is made to run alternately to move a frame, by which an article being sewn is supported, through the driving force transmitting member provided on the belt.

In the above-described drive unit of the prior art, the timing belt generates elongation when the unit is driven, and an error in movement is caused by backlash when the timing pulleys are reversed. Therefore, it is difficult to perform precise control of movement of the frame, on which an article being sewn is supported. Accordingly, in some cases, correction control of various types is needed for compensation of the above-mentioned disadvantage.

SUMMARY OF THE INVENTION

The present invention has been proposed to preferably solve the disadvantage inherent in the above-mentioned prior art, and provides as its object a sewing machine frame drive device capable of precisely conveying on an X-Y coordinate plane a frame, on which an article being sewn is set.

To overcome the above-mentioned problem and to preferably attain the intended object, a sewing machine frame drive device, according to the present invention, comprises X-direction drive units and Y-direction drive units for imparting driving forces to a frame of various types, on which an article being sewn is set, at least one of the drive units being composed of screw rods rotatingly driven by a motor in alternate directions, and moving bodies threaded on the screw rods.

Further, the frame driving unit is composed of a screw rod and a moving body threaded on the screw rod to eliminate any contracting and extending element from a driving force transmitting system and to involve less influence due to backlash, so that the frame can be precisely driven.

DETAILED DESCRIPTION OF THE PREFERRED EMBODIMENT (First Embodiment)

Figure 1:
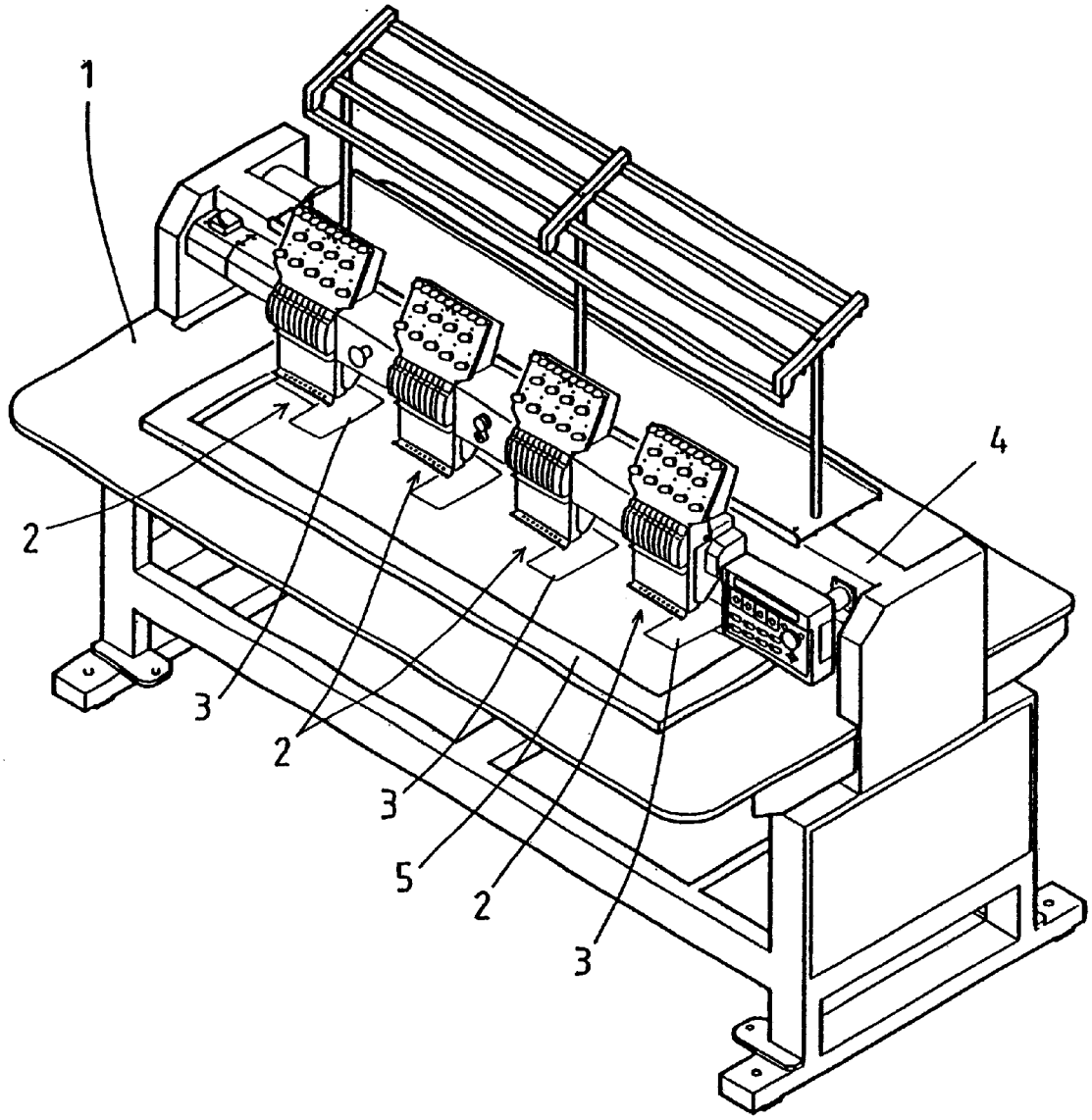
FIG. 1 is a perspective view showing the appearance of an embroidery sewing machine, to which a sewing machine frame drive device according to a first embodiment of the invention is applied.

A sewing machine frame drive device according to the present invention will be described hereinbelow with reference to the accompanying drawings, giving a preferred embodiment, in which it is applied to a multi-head embroidery sewing machine. FIG. 1 is a perspective view showing a multi-head embroidery sewing machine having four heads. A frame 4 is mounted horizontally above a sewing machine table 1, and four sewing machine heads 2 in total are arranged on the front sure of the frame 4. Mounted on the underside of the sewing machine table 1 below the respective serving machine heads 2 are shuttle bases (not shown), which support shuttles. The top surfaces of the respective shuttle bases are covered by throat plates 3 mounted on the sewing machine table 1. Placed on the sewing machine table 1 is a rectangular-shaped embroidery frame 5, and arranged on the underside of the sewing machine table 1 are two X-direction drive units 6, 6 and two Y-direction drive units 7, 7. The embroidery frame 5 is connected to the X-direction drive units 6 and the Y-direction drive units 7, respectively, through slits 8*a* formed in covers 8, which cover the upper surface of the sewing machine table 1.

Figure 3:
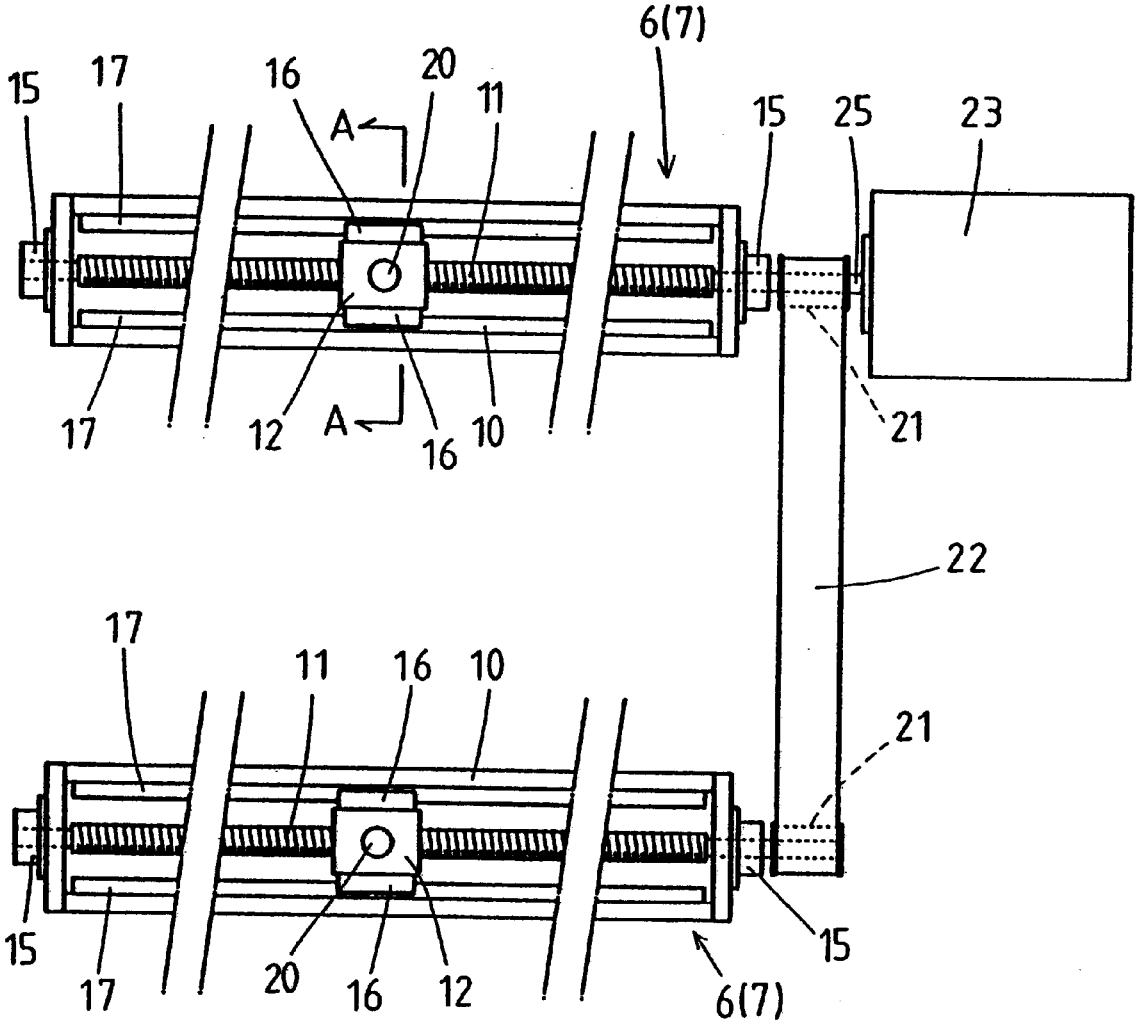
FIG. 3 is a plan view showing a state of pairs of drive units being connected.
Figure 4:
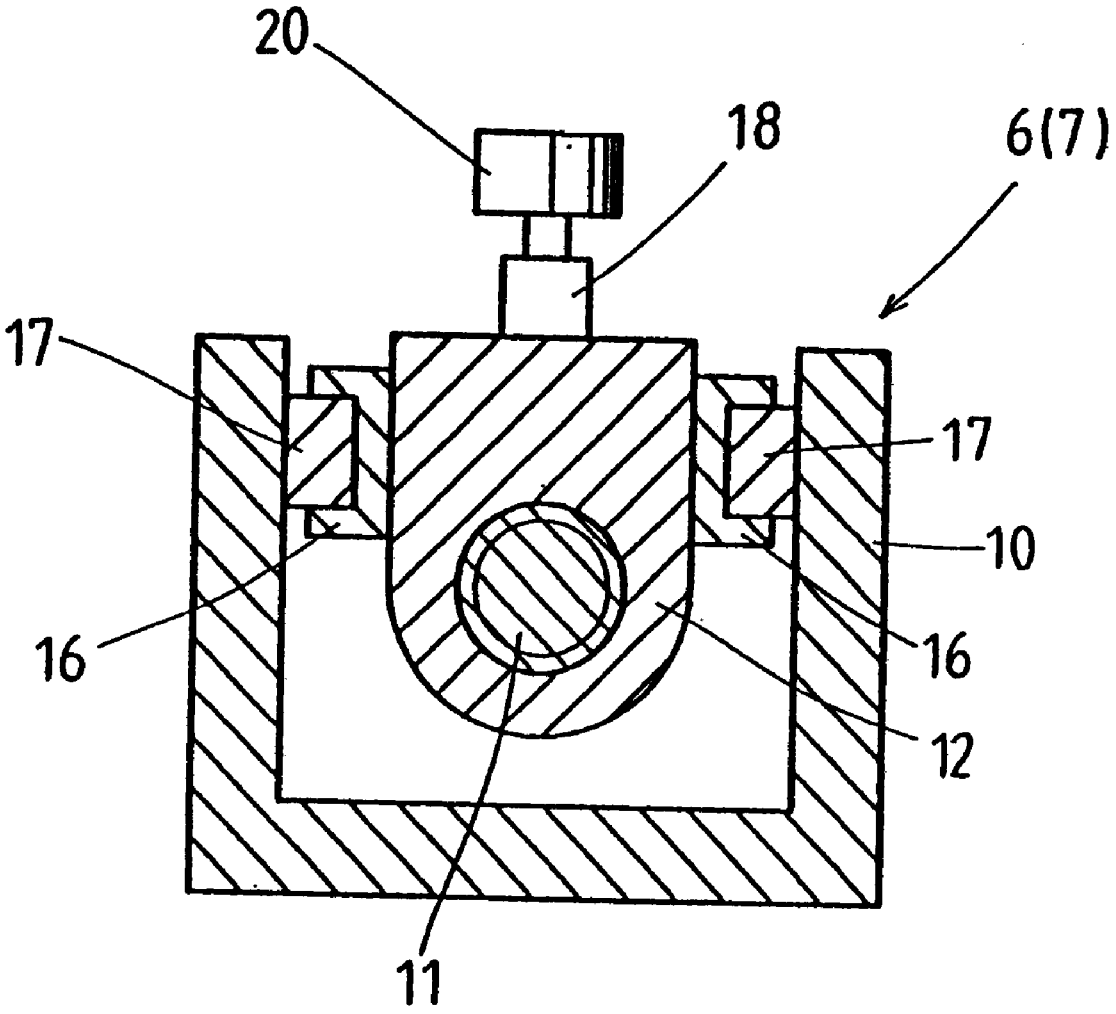
FIG. 4 is a cross sectional view taken along the line A—A in FIG. 3.

The X-direction drive units 6 and the Y-direction drive units 7 are mainly composed of a screw rod 11 (commonly called ball screw), which is rotatably supported in a frame member 10 having a C-shaped cross section, and a nut member 12 adapted to be threaded on the ball screw 11 to function as a moving body, as shown in FIGS. 3 and 4. The ball screw 11 extends lengthwise in the frame member 10 and is supported by bearings 15, 15, respectively, fixed on both ends of the frame member 10. As clearly shown in FIG. 4, linear guides 16, 16 are correspondingly fixed to both sides of the nut member 12 threaded on the ball screw 11. The respective linear guides 16, 16 are correspondingly fixed on and supported by linear rails 17, which are mounted on inner sides of the frame member 10 to be in parallel to the ball screw 11 and function to stop rotation of the nut member 12. A support stud 18 is provided vertically upwardly on the top surface of the nut member 12, and a roller 20 is supported on an upper end of the support stud 18 to be rotatable on a horizontal plane.

As shown in FIG. 3, one ends of the ball screws 11 in the X-direction drive units 6 (and the Y-direction drive units 7) are extended from the bearings 15, timing pulleys 21 are fitted on specific ends of the ball screws, and a timing belt 22 is extended between the timing pulleys 21. Connected to an end of one of the ball screws 11 via a coupling member (not shown) is an output shaft 25 of a motor 23. Accordingly, when the motor 23 is activated, the pair of ball screws 11 are rotated in the same direction through the timing belt 22, and the two nut members 12 are correspondingly moved in the same direction.

Figure 2:
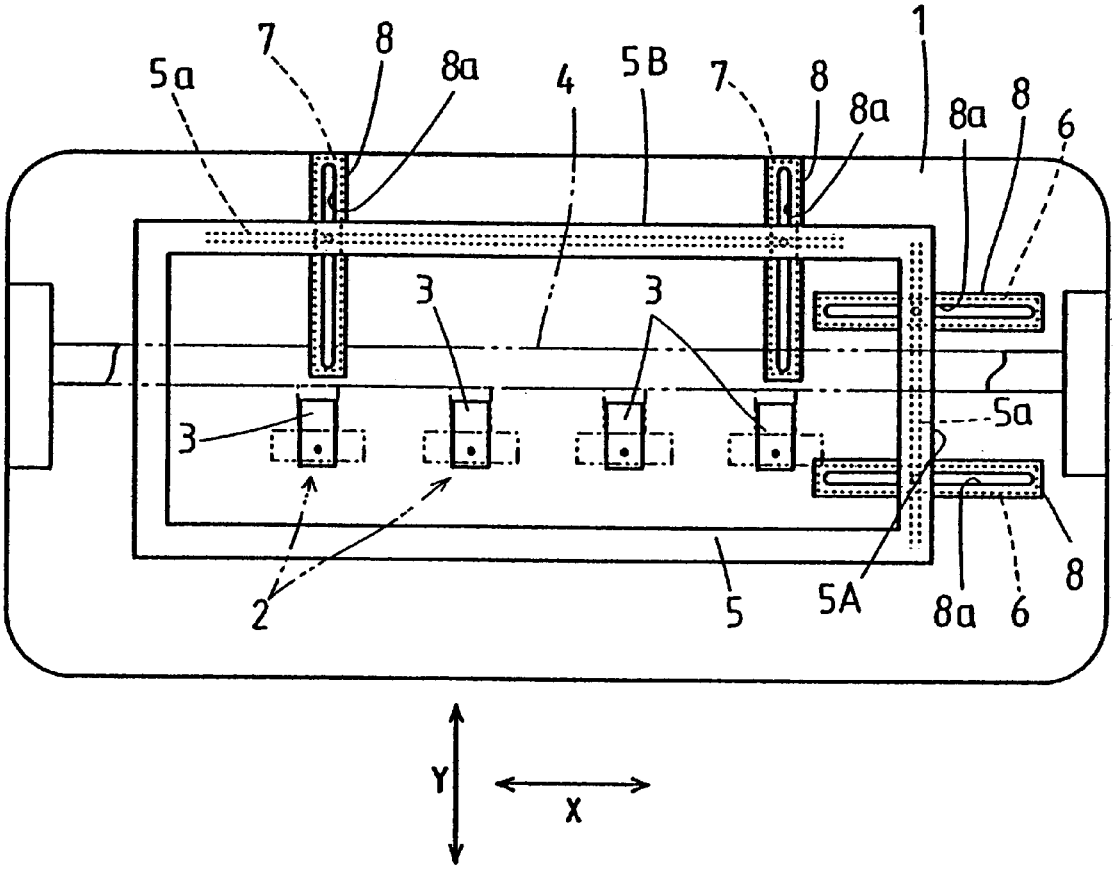
FIG. 2 is a partially cutaway plan view showing the embroidery sewing machine of FIG. 1.
Figure 5:
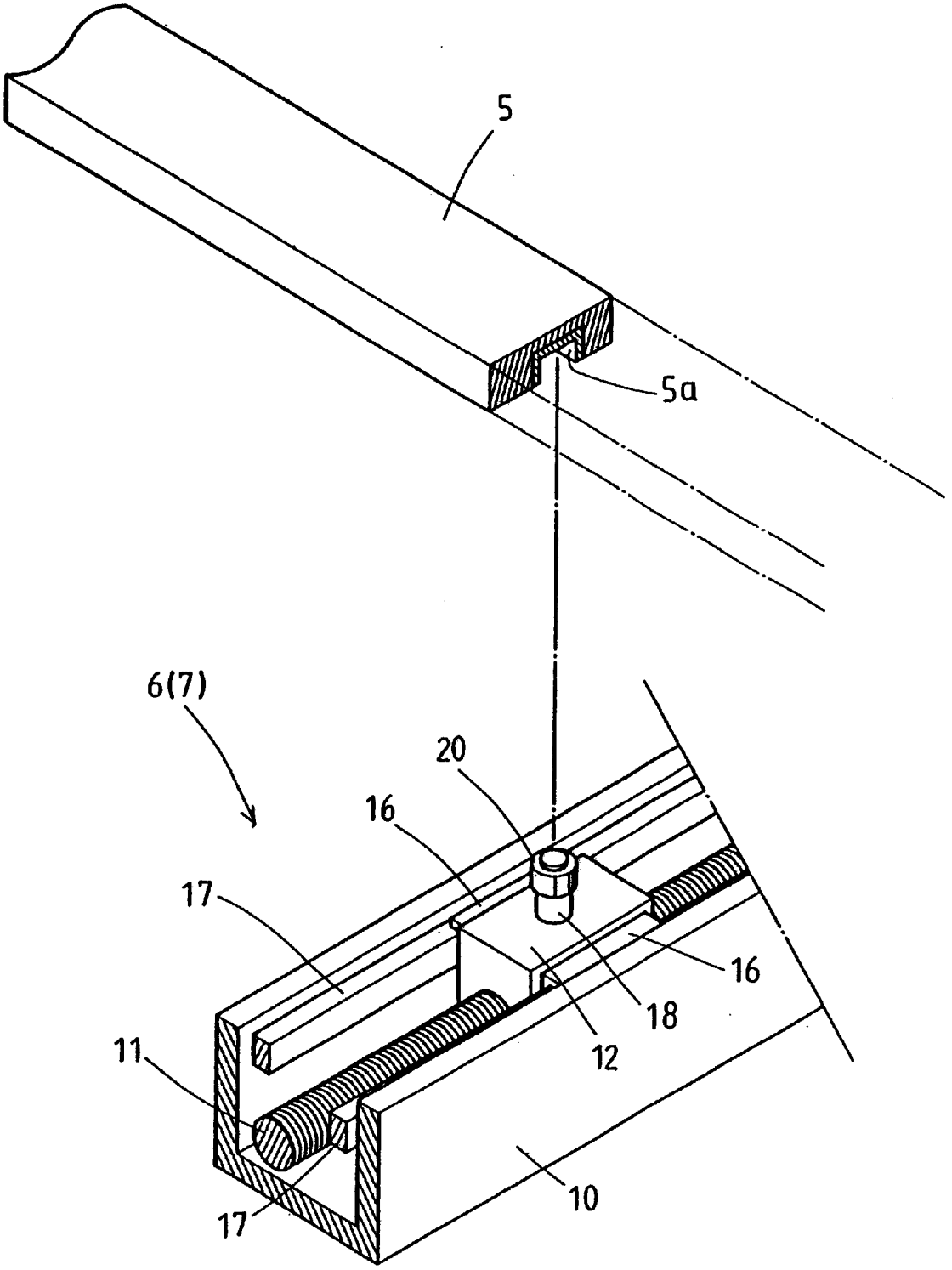
FIG. 5 is a partially cutaway perspective view showing a state, in which the drive units are connected to a frame.

The rollers 20 provided on the respective support studs 18 of the X-direction drive units 6 and of the Y-direction drive units 7 extend above the sewing machine table 1 through slits 8*a* of the covers 8 on the sewing machine table 1 shown in FIG. 2, and are substantially closely fitted in an engagement groove 5*a* formed on the underside of the embroidery frame 5 placed on the sewing machine table (see FIG. 5). In this case, both the rollers 20, 20 in the X-direction drive units 6 are correspondingly fitted in the engagement groove 5*a* in a right hand piece 5A of the embroidery frame 5, and both the rollers 20, 20 in the Y-direction drive units 7 are correspondingly fitted in the engagement groove 5*a* in a right hand piece 5B of the embroidery frame 5 (see FIG. 2).

Thus the sewing machine frame drive device according to this embodiment is constructed in the above manner, and the motor 23 allotted to the X-direction drive units 6 and the motor 23 allotted to the Y-direction drive units 7 are activated to drive the pair of drive units so that the embroidery frame 5 is controlled to be freely movable in the X-Y coordinates. Since no extending and contracting elements in a transmitting mechanism in the prior art are provided in the respective drive units 6, 7, transmission of driving forces by the motors 23 is extremely precisely performed.

Figure 6:
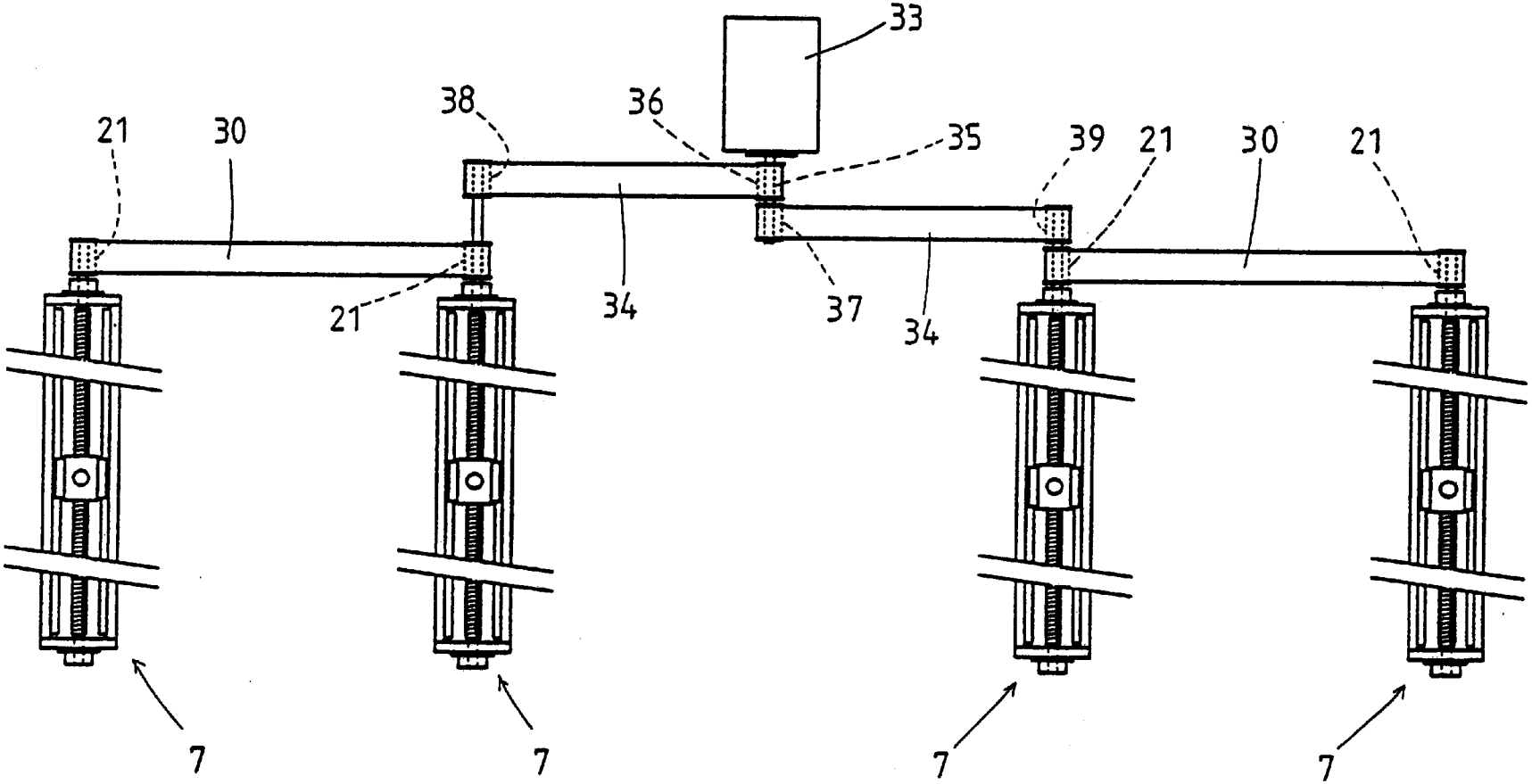
FIG. 6 is a plan view showing a state, in which the respective pairs of drive units are connected in a different fashion.

In the case where the number of sewing machine heads provided in the embroidery sewing machine is great, the embroidery frame 5 in the embodiment shown in FIG. 2 is larger in the X direction. Thus, in order to stably perform driving of the embroidery frame 5 in the Y direction, there is involved a need for increasing the number of the Y-direction drive units 7. FIG. 6 shows a modification of a manner of connecting the respective Y-direction drive units 7 in such a case. In the case where four of the Y-direction drive units 7 are connected as in the modification, two of the Y-direction drive units 7 disposed on opposite sides are connected to each other by a timing belt 30. Further, a motor 33 disposed in a middle position is connected to two of the Y-direction drive units 7, respectively, disposed inward by timing belts 34, 34. Thus two timing pulleys 36, 37 are mounted on an output shaft 35 of the motor 33, and timing pulleys 38, 39 are mounted on shaft ends of the two Y-direction drive units 7 disposed inward. The timing belts 34, 34 are extended between the timing pulleys 36, 38 and between the timing pulleys 37, 39. Accordingly, all the Y-direction drive units 7 are driven synchronously when the motor 33 is activated.

Figure 7:
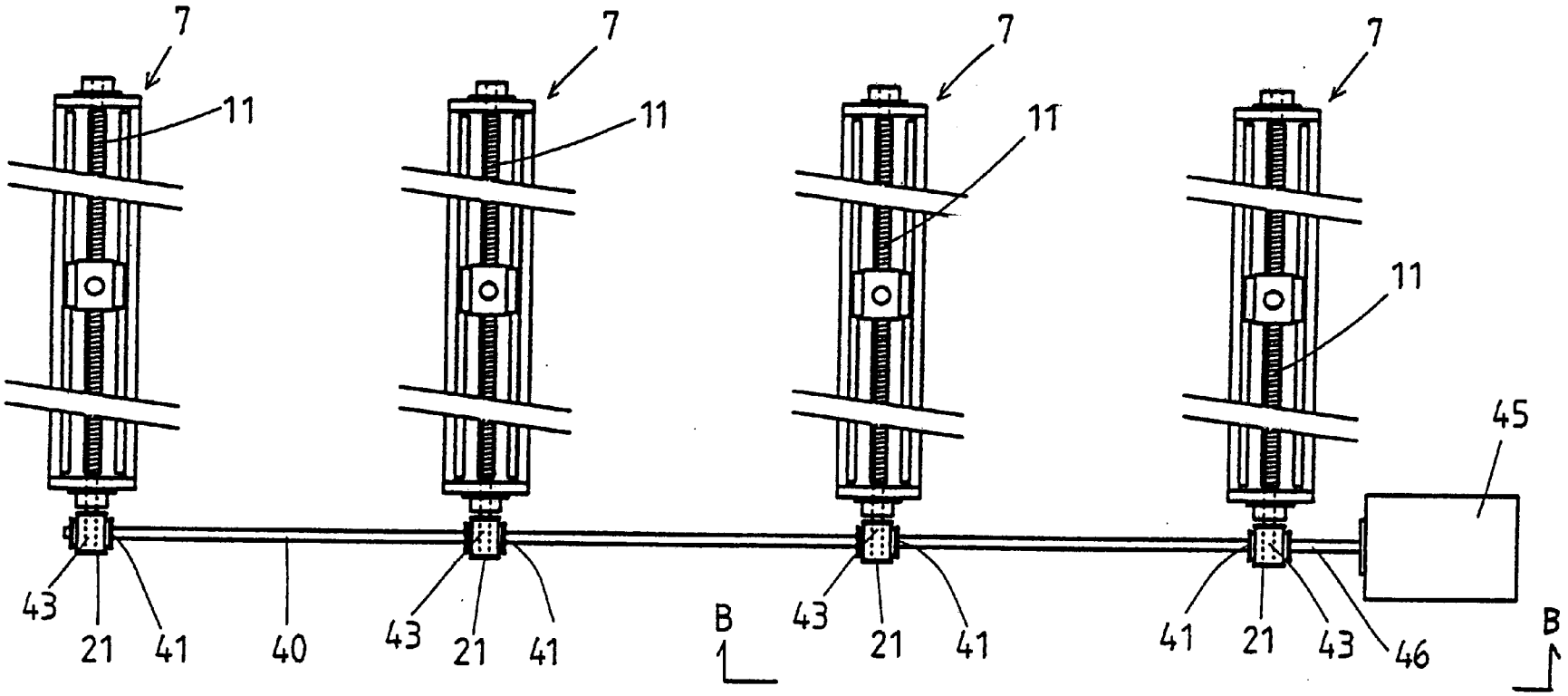
FIG. 7 is a plan view showing a state, in which the respective pairs of drive units are further connected in a different fashion.
Figure 8:
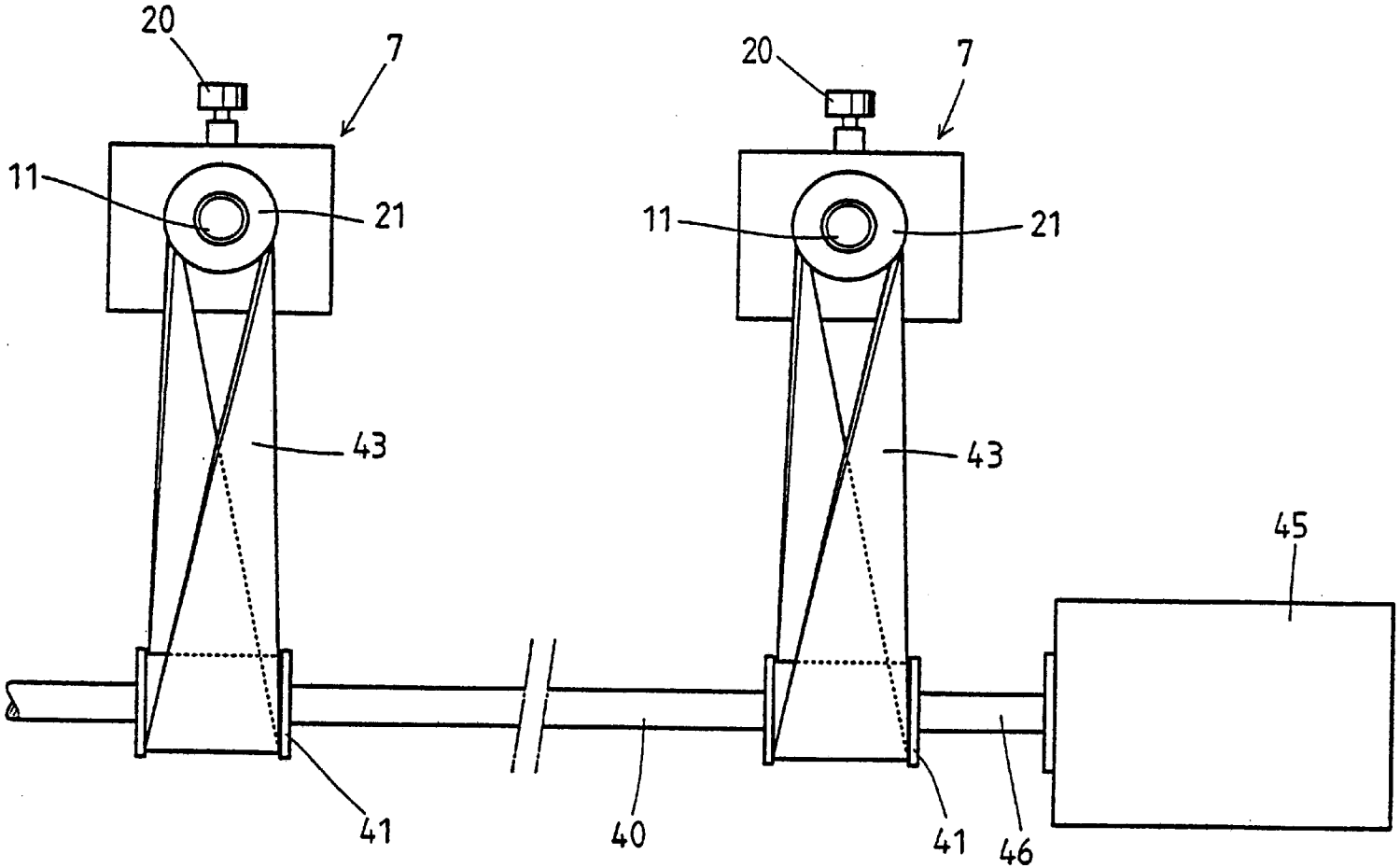
FIG. 8 is an illustration as viewed from a direction of the line B—B.

FIGS. 7 and 8 show another way of connection in the case where a multiplicity of Y-direction drive units 7 are provided, like the modification described above. More specifically, a drive shaft 40 is arranged in a position spaced a predetermined distance from and below timing pulleys 21, which are mounted on shaft ends of ball screws 11 in the respective Y-direction drive units 7, and is made perpendicular to the ball screws 11. The drive shaft 40 mounts thereon timing pulleys 41 disposed immediately below the respective timing pulleys 21, and timing belts 43 are twisted 90 degrees and extended between the respective timing pulleys 41 and the timing pulleys 21 disposed thereabove. The drive shaft 40 is connected at its end to an output shaft 46 of a motor 45 through a connection member (not shown).

(Second Embodiment)

Figure 9:
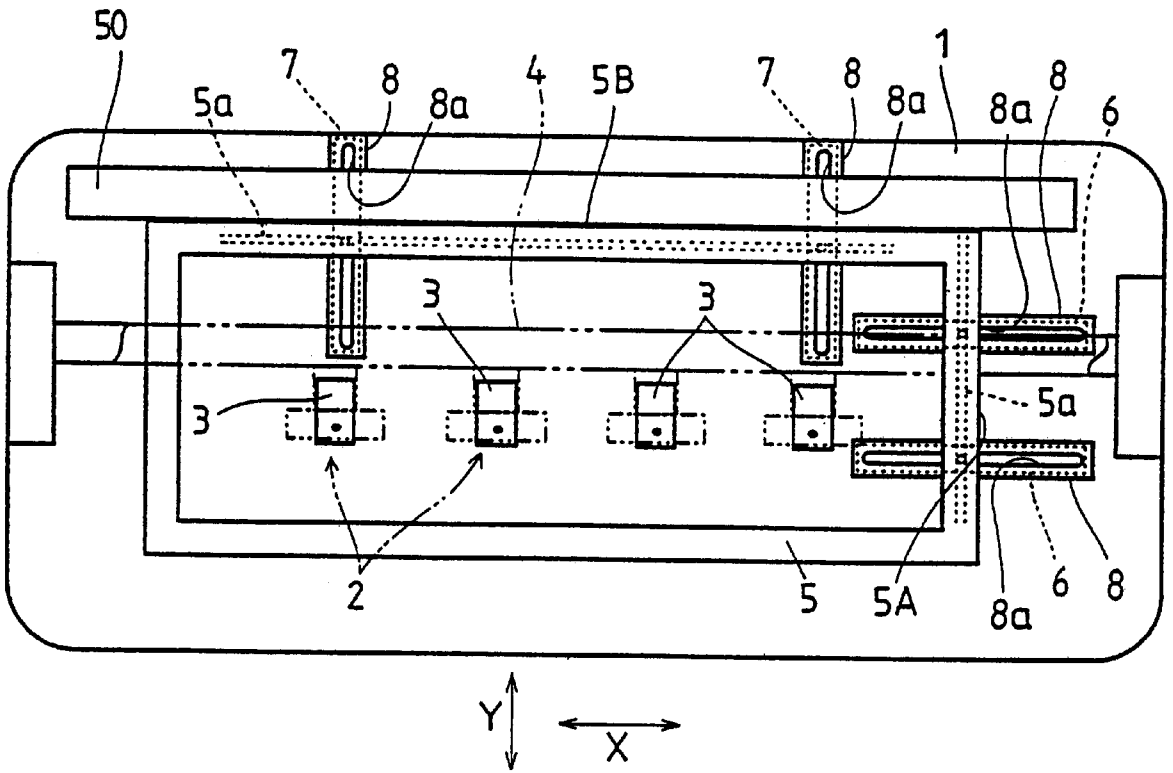
FIG. 9 is a partially cutaway plan view showing an embroidery sewing machine according to a second embodiment.
Figure 10:
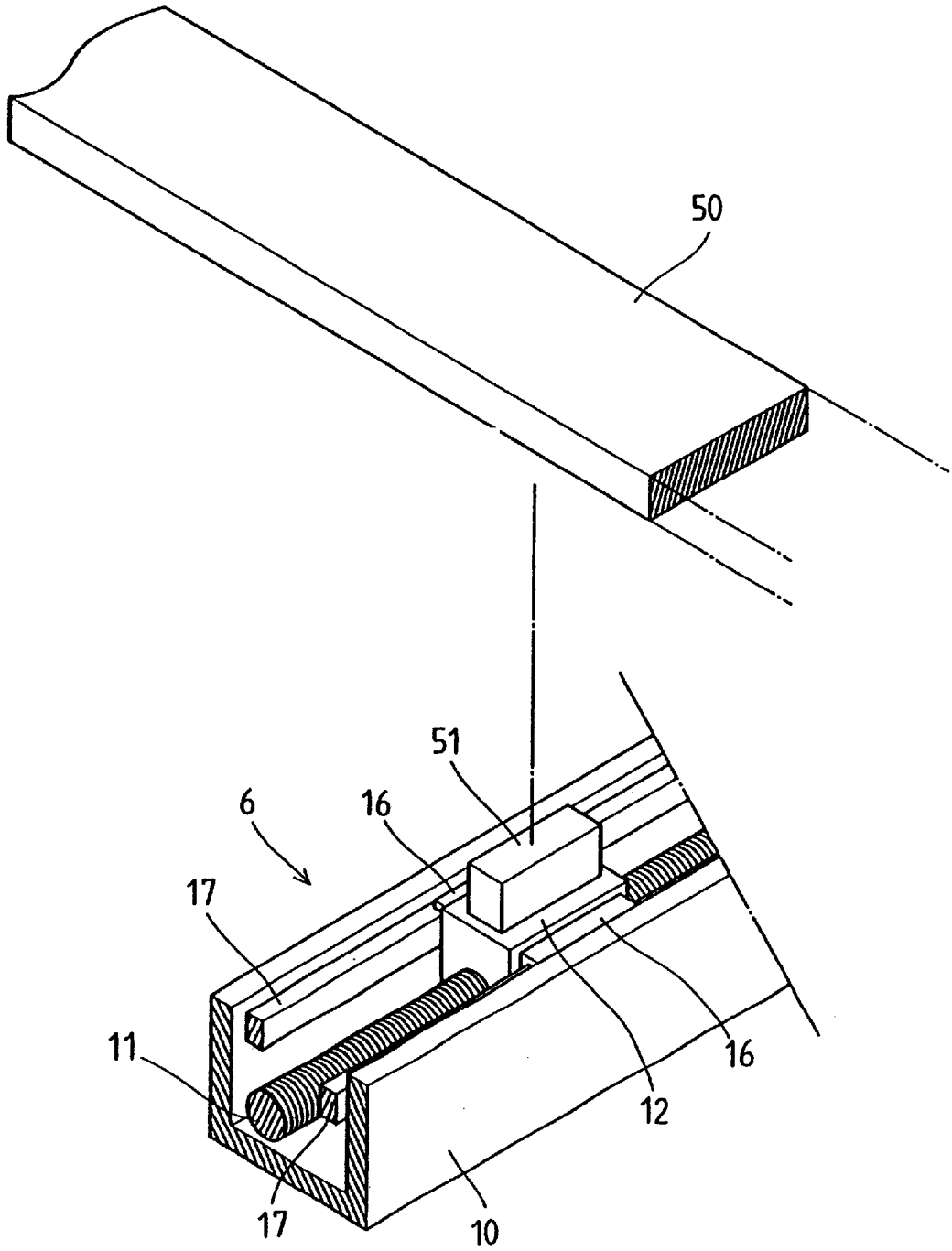
FIG. 10 is a partially cutaway perspective view showing a state, in which drive units in the second embodiment are connected to a frame.

FIGS. 9 and 10 show a preferred second embodiment of the invention. This embodiment is different from the first embodiment in that driving forces are transmitted indirectly to the embroidery frame 5 from the respective Y-direction drive units 7. In addition, the same elements as those in the first embodiment are designated by the same reference numerals, and an explanation thereof is omitted. A Y-direction driven body 50, which is longer than a rear side piece 5B of the embroidery frame 5, is arranged on the upper surface of the sewing machine table 1 to be rearwardly of and in parallel to the rear side piece 5B. As shown in FIG. 10, spacers 51 in place of the rollers 20 in the first embodiment are fixed to nut members 12 on the Y-direction drive units 7, and the top surfaces of both spacers 51 project upward through the slits 8*a* formed in the covers 8, which cover the upper surface of the sewing machine table 1. The Y-direction driven body 50 is mounted on the top surfaces of these spacers 51. The Y-direction driven body 50 and the rear side piece 5B of the embroidery frame 5 are connected to each other so that the rear side piece 5B of the embroidery frame 5 is movable relative to the Y-direction driven body 50 in the X direction. Such a connection method can employ roller pairs, and various other known connection methods.

In the second embodiment, transmission of driving forces to the embroidery frame 5 from the respective Y-direction drive units 7 is performed via the Y-direction driven body 50. Since driving forces in the Y direction can be uniformly exerted on the embroidery frame 5 even in any position where the embroidery frame 5 is moved, there is produced an advantage that the embroidery frame 5 is moved without generation of distortion. In the second embodiment, the embroidery frame 5 is driven by the Y-direction driven body 50 only in the Y direction, but a similar construction may be employed in the X direction. More specifically, an X-direction driven body is connected directly to both X-direction drive units 6, 6 so that driving forces in the X direction are transmitted to the embroidery frame 5 through the X-direction driven body. In this case, the embroidery frame 5 can be more precisely moved by arranging both X-direction drive units 6, 6 between both Y-direction drive units 7, and positioning respective ends of the Y-direction driven body 50 and the X-direction driven body so as not to have them overhanging outside the respective rows of the drive units. Of course, the X-direction driven body may be provided for the X-direction drive units.

(Other Embodiments)

(1) In the embodiments described above, a so-called "material cloth fabrics frame", which directly holds material cloth fabrics and holds small-sized embroidery frames of various types corresponding to respective sewing machine heads, is illustrated as an embroidery frame, but the present invention is not limited thereto. It is understood that a frame body recited herein indicates a comprehensive concept including all frame members driven in a direction of X-Y coordinates, for example, a base frame holding a bag frame, a cap frame or the like.

(2) In the embodiments described above, a timing belt or belts for connection of a pair or pairs of drive units are referred to as an example, but the present invention is not limited thereto. For example, other connecting means such as wire connection, gear connection or the like may be employed.

(3) In the embodiments described above, a pair or pairs of drive units are connected to each other and driven by a common motor, but individual motors may be provided for respective drive units to be subjected to synchronous control.

(4) Vertical load from the embroidery frame is not exerted on the nut members provided on the drive units in the embodiments described above. Accordingly, it is unnecessary to use the guide member composed of the linear rail and the linear guide in the illustrated examples provided that measures is effectively employed for inhibiting rotation of the nut members.

(5) The embodiments described above employ the constitution, in which the screw rod and the moving body threaded onto the screw rod are combined to drive both of the X-direction drive unit and the Y-direction drive unit. The combination of the screw rod and the moving body may be used only for either of the drive units.

As described above, the sewing machine frame drive device according to the present invention enables performing precise control of movements of the frame, so that an article being sewn can be conveyed in accordance with sewing data even when additional correction control is not implemented, and so a useful effect is obtained in achieving precise sewing.

What is claimed is:

1. A sewing machine frame drive device comprising X-direction drive units and Y-direction drive units for imparting driving forces to a frame of various types, on which an article being sewn is set, at least one of the drive units being composed of screw rods rotatingly driven by a motor in alternate directions, moving bodies threaded on the screw rods, frame members having a C-shaped cross section for rotatably supporting the screw rods, linear guides provided correspondingly on both sides of the moving bodies, the linear guides, respectively, being correspondingly fitted on and supported by linear rails, which are mounted on inner sides of the frame members to be in parallel to the screw rods, to inhibit rotation of the moving bodies, and wherein the moving bodies are nut members threaded on the screw.

2. A sewing machine frame drive device comprising X-direction drive units and Y-direction drive units for imparting driving forces to a frame of various types, on which an article being sewn is set, at least one of the drive units being composed of screw rods rotatingly driven by a motor in alternate directions, moving bodies threaded on the screw rods, frame members having a C-shaped cross section for rotatably supporting the screw rods, support studs provided on upper surfaces of the moving bodies to face upward, rollers rotatably supported on upper ends of the support studs to project above a sewing machine table through slits in covers and to be fitted in engagement grooves formed on the underside of the frame placed on the sewing machine, and wherein the moving bodies are nut members threaded on the screw.

3. The sewing machine frame drive device according to claim 2, wherein both rollers on the X-direction drive units are correspondingly fitted in the engagement groove on a right hand piece of the frame and both rollers on the Y-direction drive units are correspondingly fitted in the engagement groove on a rear side piece of the frame.

* * * * *